US006149530A

United States Patent [19]

Shih

[11] Patent Number: 6,149,530

[45] Date of Patent: Nov. 21, 2000

[54] BILLIARD TABLE BASE CONFIGURATION

[76] Inventor: Tung Yuan Shih, No. 15-3, Chung Shan Road, Hsin Shih Shiang, Tainan Hsien 744, Taiwan

[21] Appl. No.: 09/376,394

[22] Filed: Aug. 18, 1999

[51] Int. Cl.[7] ..... A63D 15/00

[52] U.S. Cl. ..... 473/22; 473/25; 273/126 R

[58] Field of Search ..... 473/FOR 1–26; 108/187; D6/446; 273/126 R, 126 A

[56] References Cited

U.S. PATENT DOCUMENTS

| | | | |
|---|---|---|---|
| 240,461 | 4/1881 | Reingardt | 473/25 |
| 1,391,909 | 9/1921 | McCool | 473/25 |
| 2,047,048 | 7/1936 | Abbot et al. | 473/22 |
| 3,156,467 | 11/1964 | Rucker | 273/126 R |
| 5,154,419 | 10/1992 | Madhavan | 273/126 R |
| 6,769,729 | 7/1998 | D'Aguiar | 473/22 |

*Primary Examiner*—Sebastiano Passaniti
*Assistant Examiner*—Mitra Aryanpour
*Attorney, Agent, or Firm*—Charles E. Baxley

[57] ABSTRACT

A billiard table includes a peripheral frame secured on top of a base and having two side beams and two end beams, a stone plate and a peripheral guide chute and a peripheral wall secured to the peripheral frame. The side and the end beams each having an inner beam member secured to the base and an intermediate and an outer beam members secured to the inner beam member. A number of support brackets are secured to the base and each having a horizontal portion extended to support the beam members and secured to the beam members and each having a reinforcing member for reinforcing purposes.

1 Claim, 6 Drawing Sheets

BILLIARD TABLE BASE CONFIGURATION

BACKGROUND OF THE INVENTION

1. Field of the Invention

The present invention relates to a billiard table, and more particularly to an improved billiard table base configuration.

2. Description of the Prior Art

Typical billiard tables comprise a base including four or more legs extended downward therefrom for elevating the base to a required level, and including a stone plate of such as the carbon or graphite materials secured on top of the base. A billiard cloth is then engaged onto the stone plate, and a peripheral frame of large wood blocks is then attached to the peripheral portion of the base. A peripheral wall is then secured to the peripheral frame. However, it has become more and more difficult to obtain the large wood blocks during the recent years. In addition, the large wood blocks of the peripheral frames of the billiard table may be easily distorted when seasons changed. Furthermore, in the billiard games, the exercisers may put their own weight on the peripheral frame, such that peripheral frame may be easily become loose and may be easily damaged.

The present invention has arisen to mitigate and/or obviate the afore-described disadvantages of the conventional billiard table base configuration.

SUMMARY OF THE INVENTION

The primary objective of the present invention is to provide a billiard table including an improved base configuration having a peripheral frame of increased strength and having a peripheral frame that will not be easily damaged.

In accordance with one aspect of the invention, there is provided a billiard table comprising a peripheral frame secured on top of a base and including a pair of side beams and a pair of end beams secured together and each having an inner beam member secured to the base and an intermediate beam member and an outer beam member secured to the inner beam member, a stone plate disposed on the peripheral frame, a peripheral guide chute, a peripheral flange and a peripheral wall secured to the peripheral frame, a billiard cloth secured on the stone plate, a plurality of support brackets each including a first portion secured to the base and each including a second portion extended from the first portion to engage with and to support the bottom portions of the inner beam members and the intermediate beam members and the outer beam members of the side beams and the end beams respectively, and means for securing the second portion of the support bracket to the inner beam members and the intermediate beam members and the outer beam members and to support the inner beam members and the intermediate beam members and the outer beam members on the base with the support brackets.

An adhesive material is further provided for adhering the intermediate beam members and the outer beam members to the inner beam members.

The support brackets each further includes at least one reinforcing member provided between the first portion and the second portion thereof for supporting and for reinforcing the second portion of the support brackets and for further stably supporting the side beams and the end beams on the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
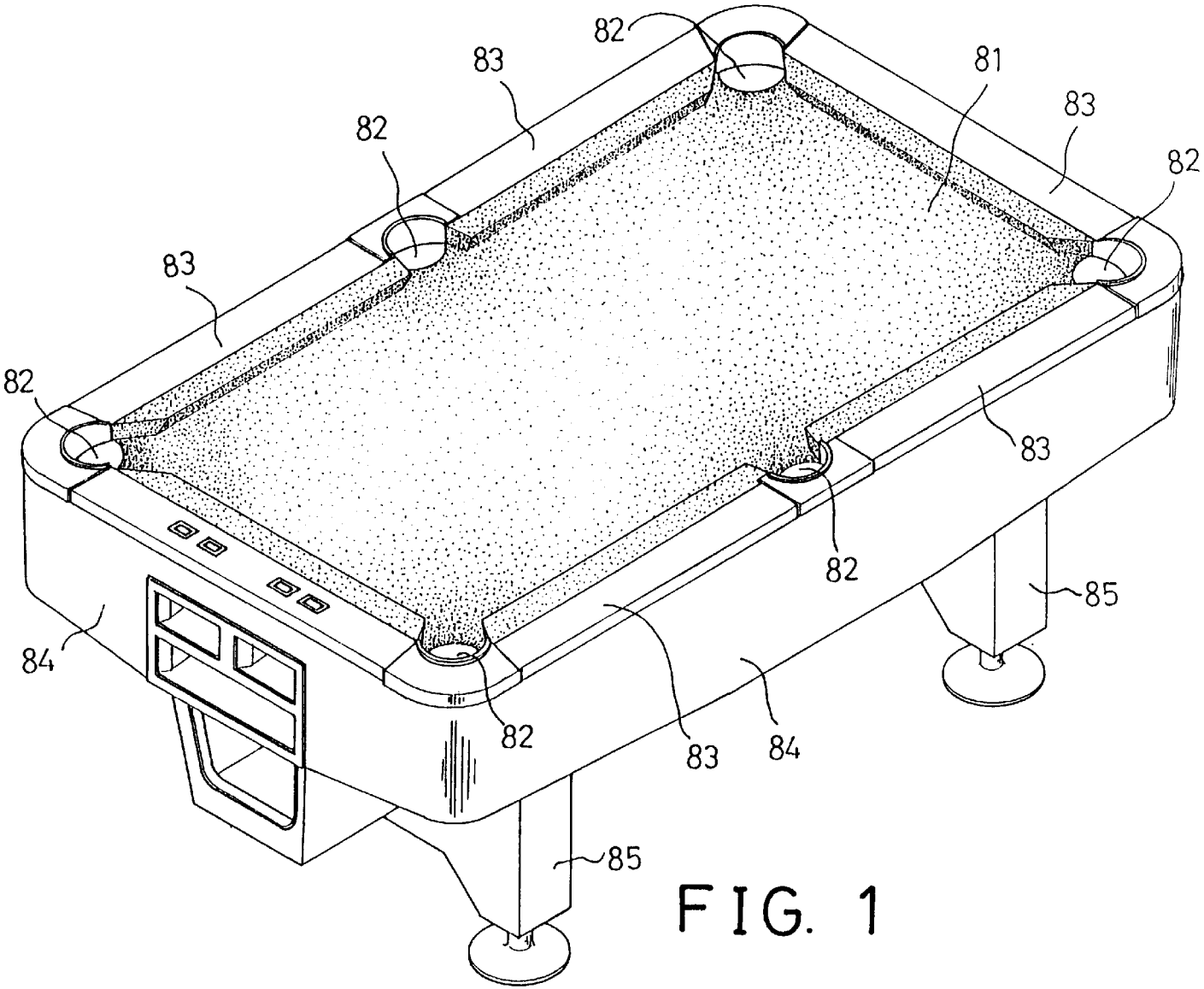
FIG. 1 is a perspective view of a billiard table in accordance with the present invention.
Figure 2:
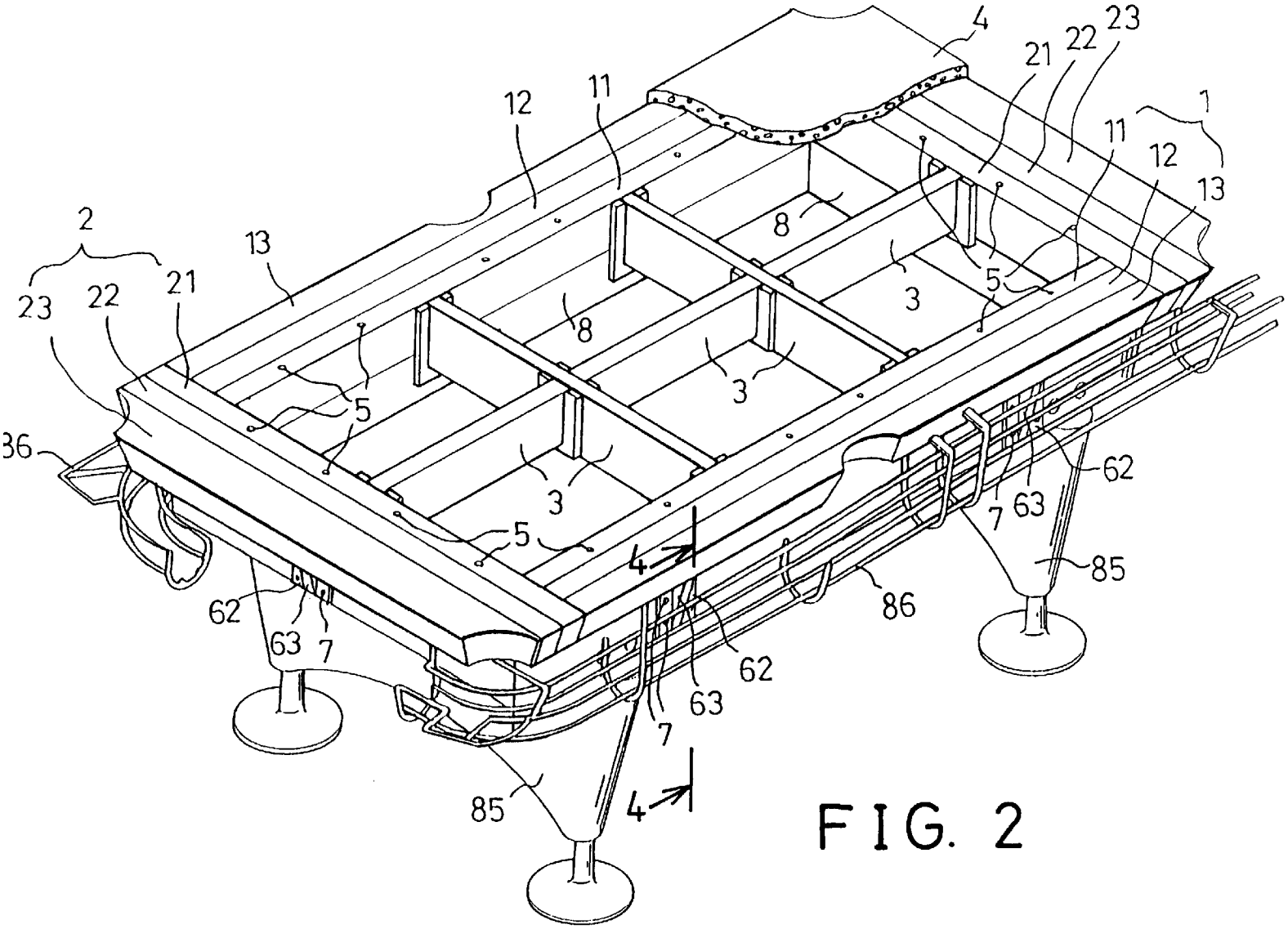
FIG. 2 is a perspective view of the billiard table, in which the billiard cloth and the peripheral wall have been removed.
Figure 3:
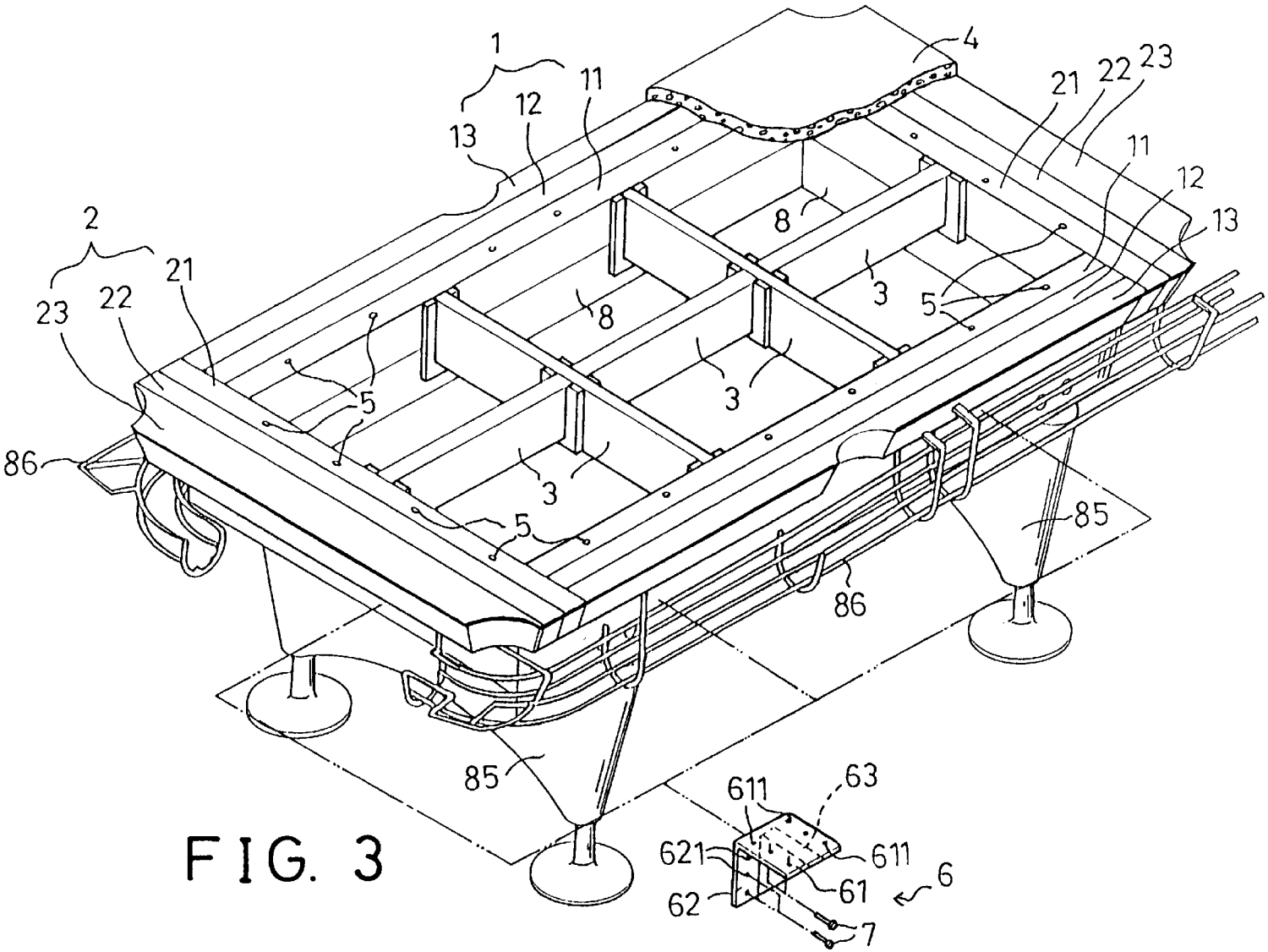
FIG. 3 is a partial exploded view of the billiard table, in which a support bracket is disengaged from the peripheral frame of the billiard table.

Referring to the drawings, and initially to FIGS. 1–4, a billiard table in accordance with the present invention comprises a base 8 including three or more legs 85 extended downward therefrom for elevating the base 8 to a suitable level. A peripheral frame includes a pair of side beams 1 and a pair of end beams 2 secured together and secured on top of the base 8 to form a substantially rectangular structure. A number of bars 3 are secured between the beams 1, 2 for reinforcing purposes. A stone plate 4 is disposed on the beams 1, 2 and the bars 3. A peripheral guide chute 86, a peripheral flange 83 and a peripheral wall 84 are secured to the peripheral portion of the beams 1, 2 of the peripheral frame, and four or more openings 82 are formed and defined in the peripheral flange 83 for receiving the billiard balls shot by the users. A billiard cloth 81 is then secured on top of the stone plate 4 and an inner peripheral portion of the peripheral flange 83 for forming the billiard table.

The side beams 1 and the end beams 2 each includes an inner beam member 11, 21, an outer beam member 13, 23 and an intermediate beam member 12, 22 secured between the inner beam member 11, 21 and the outer beam member 13 by adhesive materials and/or by fasteners. The inner beam members 11, 21 are secured to the base 8 by fasteners 5. The billiard table further includes a number of support brackets 6 each having a first portion, such as a vertical portion 62 secured to the base 8 by fasteners 7 that are engaged through the holes 621 of the support brackets 6. The support brackets 6 each includes a second portion, such as a horizontal portion 61 extended from the first portion 62 and having a length good enough to engage with the bottom portions of the inner beam member 11, 21 and the intermediate beam member 12, 22 and the outer beam member 13, 23 (FIG. 4) and to support the same in place. The second or horizontal portion 61 includes three or more holes 611 formed therein for receiving the fasteners 7 which are engaged with the inner beam member 11, 21 and the intermediate beam member 12, 22 and the outer beam member 13, 23 respectively for solidly securing the inner beam member 11, 21 and the intermediate beam member 12, 22 and the outer beam member 13, 23 to the base 8 with the support brackets 6. The support brackets 6 may each includes one or more reinforcing members 63 provided between the vertical portion 62 and the horizontal portion 61 for supporting and for reinforcing the horizontal portion 61 and for further stably supporting the beams 1, 2 in place to the base 8.

Figure 5:
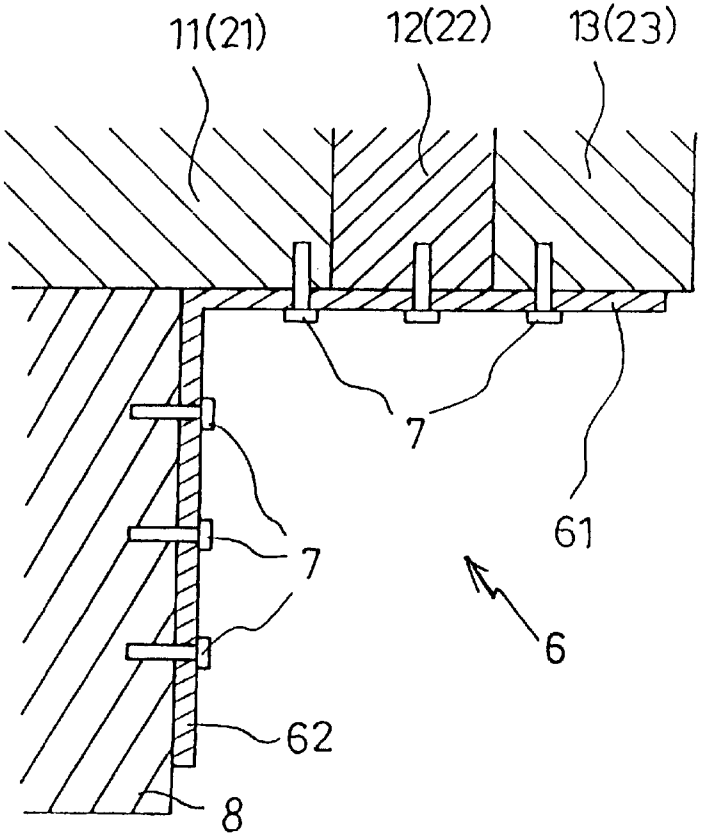
FIG. 5 is a partial cross sectional view similar to FIG. 4, illustrating another application of the support bracket of the billiard table.
Figure 4:
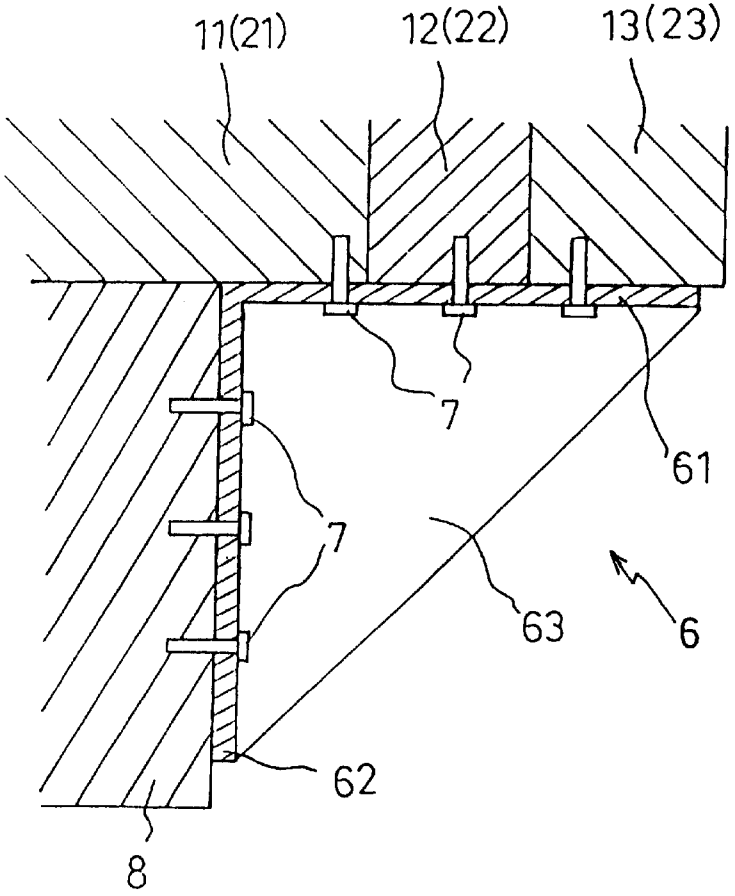
FIG. 4 is a partial cross sectional view taken along lines 4—4 of FIG. 2.
Figure 6:
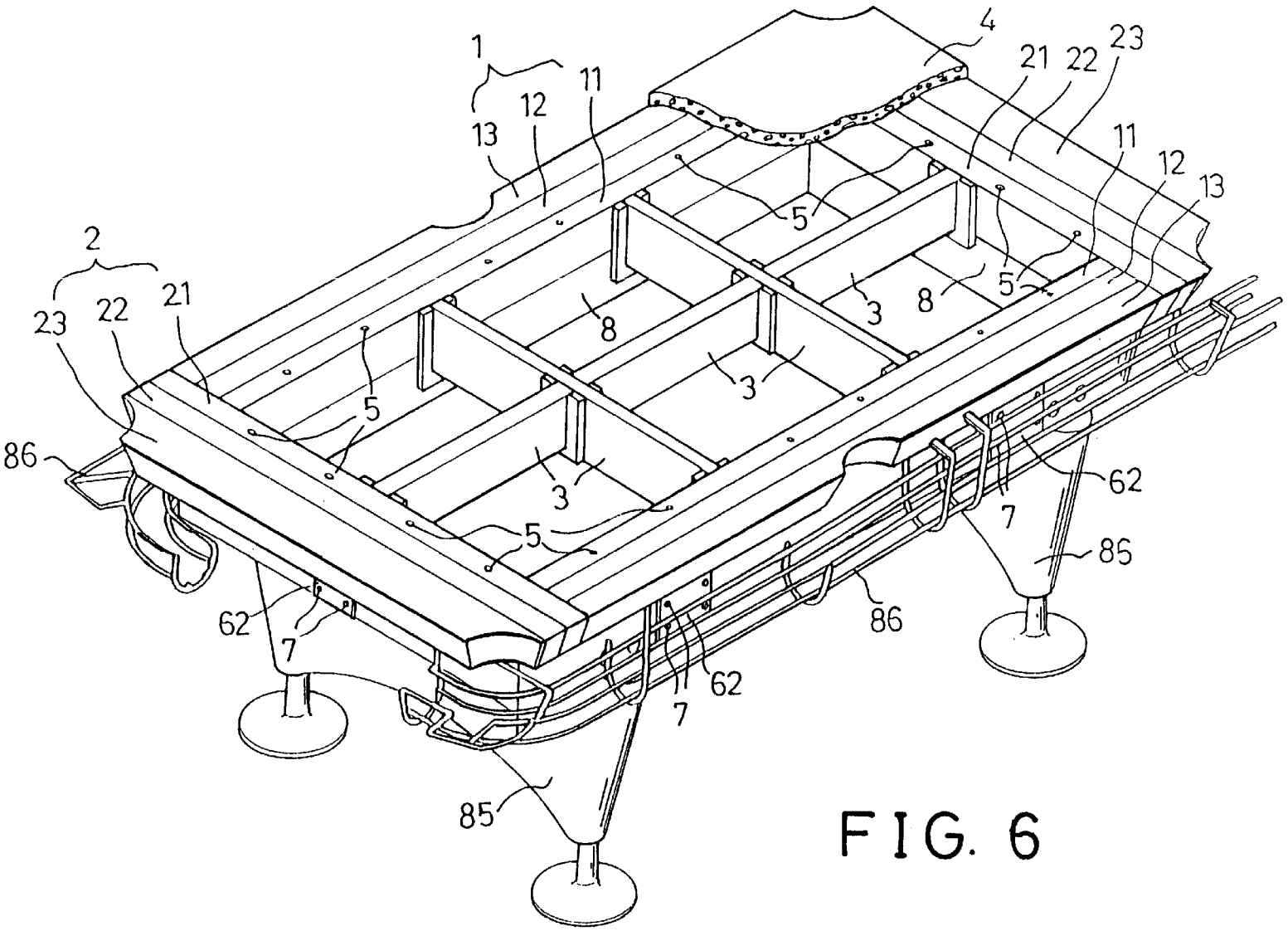
FIGS. 6 and 7 are perspective view and partial exploded views similar to FIGS. 2 and 3 respectively, illustrating the application of the support bracket as shown in FIG. 5.
Figure 7:
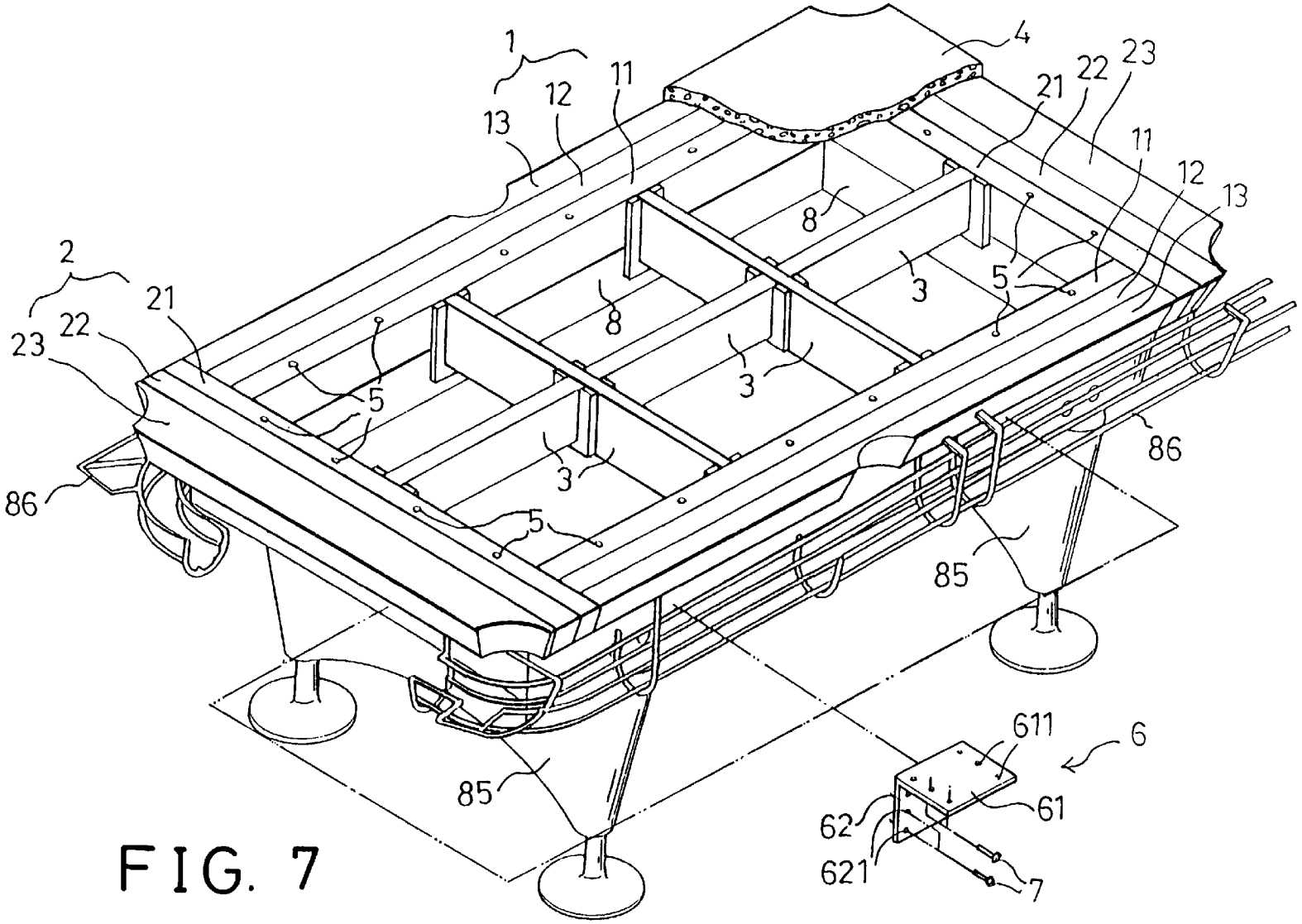

Referring next to FIGS. 5–7, the support brackets 6 of the billiard table may also be used to solidly secure the inner beam members 11, 21 and the outer beam members 13, 23 and the intermediate beam members 12, 22 to the base 8, without the reinforcing members 63, when the support brackets 6 are made of stronger materials or when the brackets 6 include a strength good enough to support the beams 1, 2 in place.

The beams 1, 2 of the peripheral frame may thus be made of a number of beam members 11, 12, 13; 21, 22, 23 which may be solidly and stably secured to the base 8 of the billiard table with the brackets 6.

Accordingly, the billiard table in accordance with the present invention includes a base configuration having a peripheral frame of an increased strength that will not be easily damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A billiard table comprising:

a) a base, b) a peripheral frame secured on top of said base, said peripheral frame including a rectangular structure having a pair of side beams and a pair of end beams secured together, said side beams and said end beams each including an inner beam member secured to said base and each including an intermediate beam member and an outer beam member secured to said inner beam member, said inner beam members and said intermediate beam members and said outer beam members each including a bottom portion, c) a stone plate disposed on said peripheral frame, d) a peripheral guide chute, a peripheral flange and a peripheral wall secured to said peripheral frame, e) a billiard cloth secured on said stone plate, f) a plurality of support brackets each including a first portion secured to said base and each including a second portion extended from said first portion to engage with and to support said bottom portions of said inner beam members and said intermediate beam members and said outer beam members of said side beams and said end beams respectively, said support brackets each further including at least one reinforcing member provided between said first portion and said second portion thereof for supporting and for reinforcing said second portion of said support brackets and for further stably supporting said side beams and said end beams on said base, and g) means for securing said second portion of said support bracket to said inner beam members and said intermediate beam members and said outer beam members and to support said inner beam members and said intermediate beam members and said outer beam members on said base with said support brackets.

* * * * *